US009766027B1

(12) United States Patent
Cavanaugh

(10) Patent No.: US 9,766,027 B1
(45) Date of Patent: Sep. 19, 2017

(54) INDIRECT IMPINGEMENT OPERATING SYSTEM FOR A FIREARM

(71) Applicant: Lawrence J. Cavanaugh, Scottsdale, AZ (US)

(72) Inventor: Lawrence J. Cavanaugh, Scottsdale, AZ (US)

( * ) Notice: Subject to any disclaimer, the term of this patent is extended or adjusted under 35 U.S.C. 154(b) by 0 days.

(21) Appl. No.: 15/174,575

(22) Filed: Jun. 6, 2016

(51) Int. Cl.
*F41A 5/24* (2006.01)
*F41A 13/10* (2006.01)

(52) U.S. Cl.
CPC ..... *F41A 5/24* (2013.01); *F41A 13/10* (2013.01)

(58) Field of Classification Search
CPC ..... F41A 5/18; F41A 5/20; F41A 5/22; F41A 5/24; F41A 5/26; F41A 5/28; F41A 5/30
USPC ..... 89/191.01–193, 125
See application file for complete search history.

(56) References Cited

U.S. PATENT DOCUMENTS 2,951,424 A * 9/1960 Stoner ..... F41A 3/16 89/179
3,386,336 A * 6/1968 Roy ..... F41A 3/72 42/75.02
3,707,110 A * 12/1972 Alday ..... F41A 5/28 89/193
4,324,170 A * 4/1982 Healy ..... F41A 5/26 89/159
5,272,956 A * 12/1993 Hudson ..... F41A 5/28 42/72
2012/0152104 A1* 6/2012 Audibert ..... F41A 5/18 89/191.01
2012/0180648 A1* 7/2012 Sullivan ..... F16J 9/16 89/193
2013/0269510 A1* 10/2013 Sullivan ..... F41A 5/28 89/193
2016/0161200 A1* 6/2016 Windauer ..... F41A 5/28 89/193

* cited by examiner

*Primary Examiner* — Jonathan C Weber
(74) *Attorney, Agent, or Firm* — Thomas W. Galvani, P.C.; Thomas W. Galvani

(57) ABSTRACT

An operating system for a firearm includes a body, configured to be mounted to a firearm, having an interior space, a front, and an opposed rear. A piston is carried within the interior space for reciprocation between a forward position toward the front and a rearward position toward the rear. A gas port is formed proximate to the front of the body, and an outlet is formed proximate to the rear of the body. First and second gases flank the piston. Those first and second gases are isolated from each other. The piston moves to the rearward position in response to expansion of the first gas, thereby imparting movement of the second gas through the outlet. The piston also moves to the forward position in response to contraction of the first gas, assisted by a spring.

20 Claims, 3 Drawing Sheets

INDIRECT IMPINGEMENT OPERATING SYSTEM FOR A FIREARM

FIELD OF THE INVENTION

The present invention relates generally to firearms, and more particularly to operating systems for firearms.

BACKGROUND OF THE INVENTION

Since the advent of the automatic weapon, gunsmiths have sought a safe, reliable, and efficient mechanism for readying the action of a firearm quickly after a discharge. In the 1930s, the M1 Garand semi-automatic rifle was introduced. It was a gas-operated, self-loading weapon that proved to be very successful on the World War II battlefield. The Garand operated by taking a sample of expanding, hot, high-pressure gas from a fired cartridge and using that gas to push a small piston in a cylinder suspended under the barrel. This piston, in turn, pushed an operating rod to the rear, thereby rotating and unlocking the bolt. Residual energy in the rifle then pushed the operating rod and bolt fully to the rear of the stroke length, which allowed the expended brass casing to be ejected and, on the return to battery, chamber a fresh cartridge and lock the bolt, thus readying the weapon for the next shot. If the Garand had a major flaw, it was the unwanted muzzle jump produced by the weight of the entire firearm plus the large reciprocating weight. Muzzle jump produced in this way was especially problematic for weapons that are select fire, i.e., fully automatic.

In the 1950s, a new operating system was developed that used the energy from the expanding gas to rotate and open the bolt directly, without the reciprocating weight of a heavy operating rod. This, along with the utilization of lighter components made from aluminum and plastic, produced a weapon of lighter weight and better accuracy. These improvements came with a concurrent flaw, however, as along with the pulse of high-pressure gas to the bolt and bolt carrier came heat and carbon. In the early Vietnam War, this this resulted in M16 rifles jamming in combat conditions. At that time, different propellants were introduced, along with more frequent maintenance routines, to prevent this problem. In relatively recent years, there have been a number of patents granted for devices that convert M4-family direct gas rifles to a forward position and operating rod style operating system. Most recently, with respect to semi-automatic weapons, and firearms in the M4 family in particular, two camps of development emerged to address this issue: a first camp extolling direct impingement operating systems, and a second championing gas-piston operating systems. Both systems have unique advantages. However, the existence of drawbacks for each system still makes neither solution a perfect one.

Very basically, direct impingement operating systems route a portion of the combustion gas into the bolt carrier to cycle the action. When an operator fires the weapon, the trigger is depressed, causing the firing pin to impact the primer of a cartridge. The primer ignites, causing the ignition or propellant within the cartridge to explode. Combustion gas is thereby produced, forcing the bullet out of the cartridge casing and down the barrel. Combustion continues as the bullet travels down the barrel, producing further combustion gas. The bullet passes a gas port formed in the barrel, and a metered amount of the combustion gas passes into the gas port and back through a gas tube toward the rear of the rifle. The gas tube terminates above the bolt carrier at the gas key, thereby allowing the combustion gas to enter and directly impinge the bolt carrier, causing the bolt carrier to slam rearward, unlocking the bolt with a caroming action. The bolt carrier group then continues fully to the rear of the receiver, ejecting the spent cartridge and compressing the recoil into a spring. The spring urges the bolt carrier forward again, stripping a fresh cartridge from the magazine, and the action is cycled.

Direct impingement systems are efficient in terms of weight. They require no additional moving parts and essentially only an additional thin metal tube fixed along the barrel. However, these systems have at least one serious problem: they rely on the application of hot and dirty combustion gases directly back into the action of the firearm, thereby fouling the action. Carbon combustion particles, contaminants, moisture, and lubricants combine to leave deposits in the bolt carrier, preventing the bolt carrier from moving efficiently, effectively, and reliably with each shot. Direct impingement systems also suffer from the delays of a forced cool down time: the application of hot gas into the bolt carrier means that sometimes the firearm will overheat if not cooled. Both of these issues are irksome at the firing range, but are life threatening on the battlefield.

As a result of this recognized fouling problem, the gas-piston operating system has been revisited in recent years. Gas-pistons eliminate the additional application of combustion gas into the action, instead relying on a reciprocating rod that acts on the bolt carrier. A gas-piston-operated M16, AR15, or M4-pattern firearm, for example, includes a drive rod mounted for reciprocation above the barrel. The gas port forces combustion gas into a cylinder in the gas block containing a piston, which in turn is mechanically connected to a drive rod. The rear end of the drive rod is operatively coupled and positioned to push against a raised abutment on the bolt carrier to slam into it and push it rearward. This extracts the spent cartridge, and a spring urges the bolt carrier forward as with the direct impingement system.

While the gas-piston operating system solves the problem of fouling the bolt carrier, it presents the problem of a larger reciprocating mass on a precision weapon. The weight of the drive rod, and the speed with which it moves, affects the accuracy of the firearm. Earlier solutions pursued lighter constructions, but were more prone to failure. In addition, offset mechanical forces operating the bolt carrier present additional wear and jamming problems for the bolt carrier; some manufacturers have added roller systems to the bolt carrier to prevent scoring on upper receiver. Still further, the recoil caused by the reciprocation of the drive rod can wear on the operator over the long term, and in the short term, makes maintaining accuracy from shot to shot challenging: each time the weapon is fired, aim is slightly lost. Again, this can be cumbersome at the firing range, deadly on the battlefield.

Therefore, both direct impingement operating systems and gas-piston operating systems have their flaws. While each solves a problem, each presents one as well. An improved operating system which avoids all of these issues, and creates no new ones, is needed.

SUMMARY OF THE INVENTION

An indirect impingement operating system for a firearm forces clean, cool ambient air into the bolt carrier to cycle the action of the firearm in response to the expansion of combustion gas following the firing of a bullet. The operating system includes a body, configured to be mounted to a firearm, having an interior space, a front, and an opposed rear. A piston is carried within the interior space for reciprocation between a forward position toward the front and a rearward position toward the rear. A gas port is formed proximate to the front of the body, and an outlet is formed proximate to the rear of the body. First and second gases flank the piston. Those first and second gases are isolated from each other. The piston moves to the rearward position in response to expansion of the first gas, thereby imparting movement of the second gas through the outlet. The piston also moves to the forward position in response to contraction of the first gas.

BRIEF DESCRIPTION OF THE DRAWINGS

Referring to the drawings.

DETAILED DESCRIPTION

Figure 1:
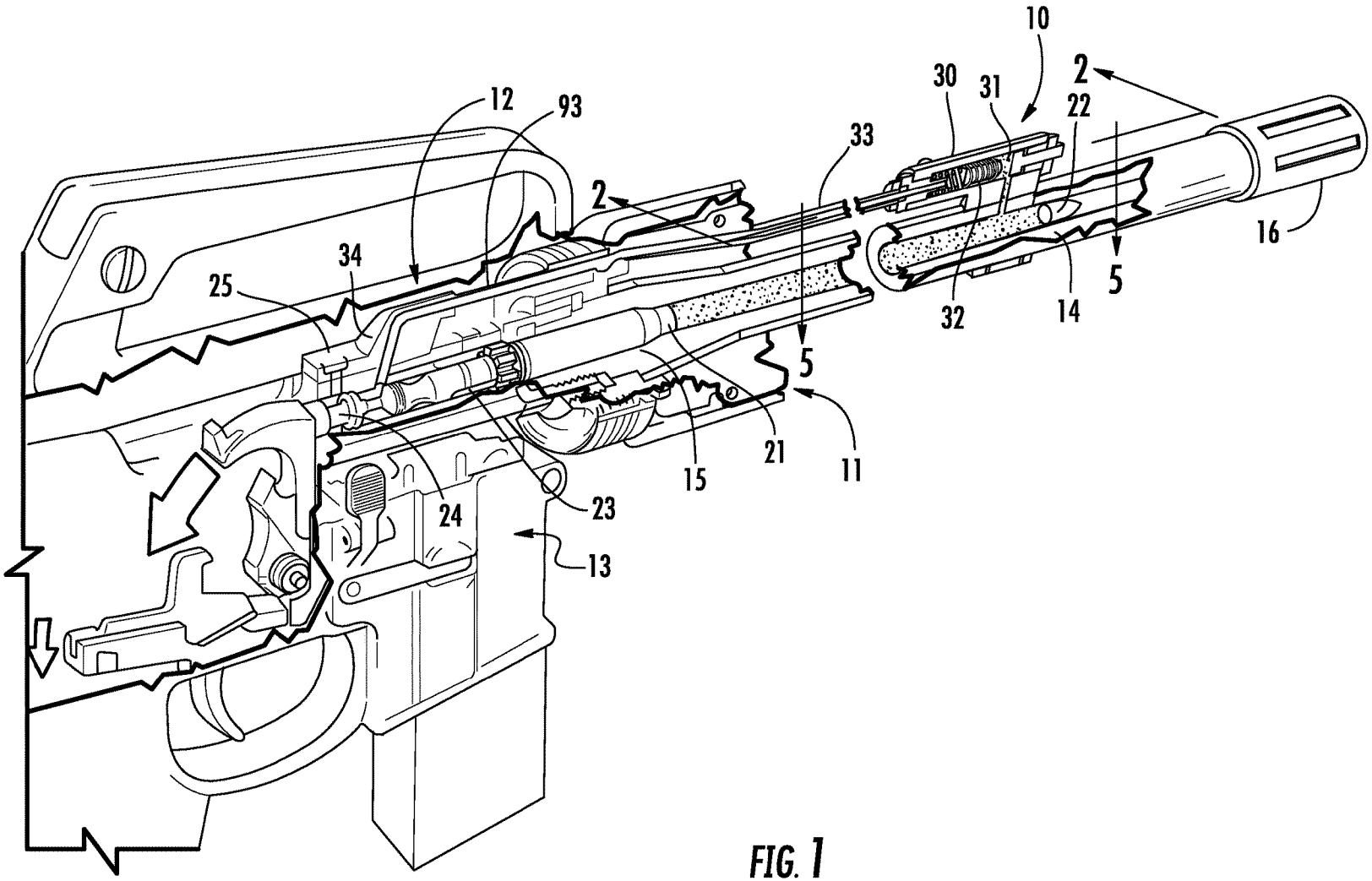
FIG. 1 is a partially revealed perspective view of an indirect impingement operating system on a firearm.

Reference now is made to the drawings, in which the same reference characters are used throughout the different figures to designate the same elements. FIG. 1 is a partially revealed perspective view of an indirect impingement operating system 10 (hereinafter, simply "the system 10") on a semi-automatic firearm 11. The system 10 enables quick, responsive, efficient, safe, and clean cycling of the action of the firearm 11. The firearm 11 is a rifle typical of the family of rifles including the M-4, M-16, AR-15, and AR-10. The firearm 11 includes an upper receiver 12, a lower receiver 13, and a barrel 14 extending from a chamber 15 to a muzzle 16. FIG. 1 shows the state of a cartridge immediately after firing, with a casing 21 left in the chamber 15 and a bullet 22 traveling down the barrel 14. The barrel 14 is rifled, however, the rifling is not illustrated so as to preserve the clarity of the illustration. A bolt 23 is against the casing 21, and a firing pin 24 is carried in the bolt 23, both of which are within a bolt carrier 25.

Generally, the system 10 includes a housing or body 30 mounted to the barrel 14, a cylinder 31 within the body 30 carrying a piston 32 for reciprocal movement, and a gas tube 33 extending out the back of the body 30 to a gas key 34. Combustion gas produced during firing communicates down the barrel 14 and into the cylinder 31 where it forces the piston 32 rearwardly with great force. The piston 32, in turn, pushes a pulse or slug of ambient air through the gas tube 33 and to the gas key 34. In this manner, the system cleanly delivers a slug of cool ambient air to the gas key 34 to move the bolt carrier 25 and cycle the action of the firearm 11. This system 10 adds only a minute amount of additional weight reciprocating over a very short distance to the firearm 11 versus a conventional firearm having a direct impingement operating system. The structure and operation of the system 10 is now described in much greater detail, with reference primarily to FIGS. 2-6. Within that discussion, the terms "forward," "forwardly," "rear," "rearwardly," and "behind" are used to identify directions and relative positions of structural elements and features. Specifically, "forward" and "forwardly" are meant to indicate a direction or position toward the muzzle 16, while the terms "rear," "rearwardly," and "behind" are meant to indicate a direction or position away from the muzzle 16.

Figure 2:
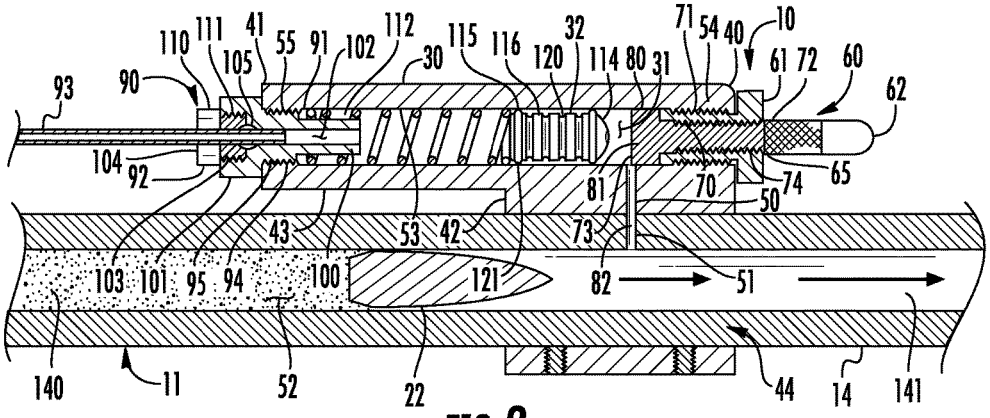
FIGS. 2-4 are enlarged section views of the operating system and the firearm taken along the line 2-2 in FIG. 1, showing a sequence of operational stages of the operating system.

FIG. 2 is an enlarged section view of the operating system 10 taken along the line 2-2 in FIG. 1. FIG. 2 illustrates in detail the operating system 10 mounted above the barrel 14 behind the muzzle 16. The operating system 10 includes the body 30 clamped to the barrel 14 and holding the reciprocating piston 32. The body 30 is generally cylindrical from a front 40 to a rear 41, and constructed from a material or combination of materials having the characteristics of hardness and durability. Between the front 40 and the rear 41, a projection 42 extends downward from an underside 43 of the body 30. The projection 42 is formed with a lateral through-hole 44 sized and shaped to receive the barrel 14. The projection 42 further includes two set screws 45 threadably engaged in the projection 42. The projection 42, together with the set screws 45, define a clamp to securely mount and carry the operating system 10 with respect to a fixed location along the barrel 14 of the firearm 11. The through-hole 44 closely receives the barrel 14 therein, and when the set screws 45 are tightened to a pre-defined torque level, they securely hold the operating system 10 on the barrel 14.

A gas port 50 extends through an upper portion of the projection 42 and a lower portion of the body 30 and is aligned with a gas port 51 formed in an upper portion of the barrel 14. The gas port 50 is thus in gaseous communication with a bore or interior 52 of the barrel 14 and thereby joins the interior 52 in gaseous communication to the cylinder 31 of the operating system 10. For convenience, because the gas ports 50 and 51 are aligned and remain aligned so long as the body 30 is securely mounted on the barrel 14, the gas ports 50 and 51 will be referred to simply as the gas port 50, unless explicitly identified otherwise.

The cylinder 31 is a cylindrical space bound within an inner surface 53 of the body 30. The cylinder 31 extends entirely from the front 40 of the body 30 to the rear 41, and is a through bore, thereby promoting easy cleaning when desired. The cylinder 31 has a generally circular cross-section. The inner surface 53 defining the cylinder 31 is smooth and featureless, except proximate to the front 40 and rear 41, where it is formed with threads 54 and 55, respectively.

At the front 40, a regulator 60 is threadably engaged with the threads 54. The regulator 60 allows the operator to adjust and select the volume of combustion gas which flows out of the gas port 50 into the cylinder 53. The regulator 60 is a two-piece assembly including an outer nut 61 and an inner stem 62. The outer nut 61 includes a forward wide flange 63 and a shank 64 extending rearward therefrom. The flange 63 and shank 64 are cylindrical, coaxial, and formed with a coaxial bore 65 extending entirely through outer nut 61. The bore 65 forms and defines an inner surface of the shank 64 which is formed with inwardly-directed threads 70. Opposed, outwardly-directed threads 71 are formed on an outer surface of the shank 64. The threads 71 on the outer surface of the shank 64 threadably engage with the threads 54 at the front 40 of the body 30, thereby allowing the outer nut 61 to be rotated in clockwise fashion until the flange 63 is seated in contact with and against the front 40 of the body 30. The threads 71 and 54 form a substantially impermeable gas seal.

The inner stem 62 includes a forward knob 72, an opposed block 73, and a shaft 74 extending therebetween. The knob 72, the block 73, and the shaft 74 are each cylindrical and coaxial. The shaft 74 is formed with outwardly-directed threads 75 which are threadably engaged to the inwardly-directed threads 70 on the inner surface of the outer nut 61, and with which a substantially impermeable gas seal is formed. The knob 72 is knurled, or otherwise provided with shapes or textures so as to provide grip to the fingers of the operator as he holds and turns the inner stem 62 with respect to the outer nut 61 to adjust the regulator 60. The block 73 of the inner stem 62 is cylindrical and has an annular outer face 80 and a flat rear face 81. The block 73 has an outer diameter equal to the inner diameter of the cylinder 31, such that the block 73 is closely and snugly received in the cylinder 31. The outer face 80 is in juxtaposition with, and mounted for sliding rotational contact along, the inner surface 53 of the cylinder 31. The block 73 forms a substantially impermeable gas seal with the cylinder 31, such that air cannot move rearwardly past the block 73 and gas cannot move forwardly past the block 73.

Figure 3:
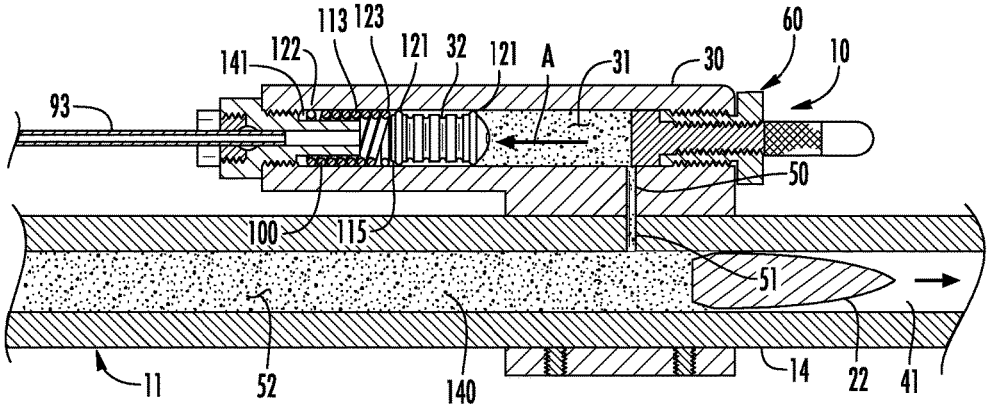
Figure 4:
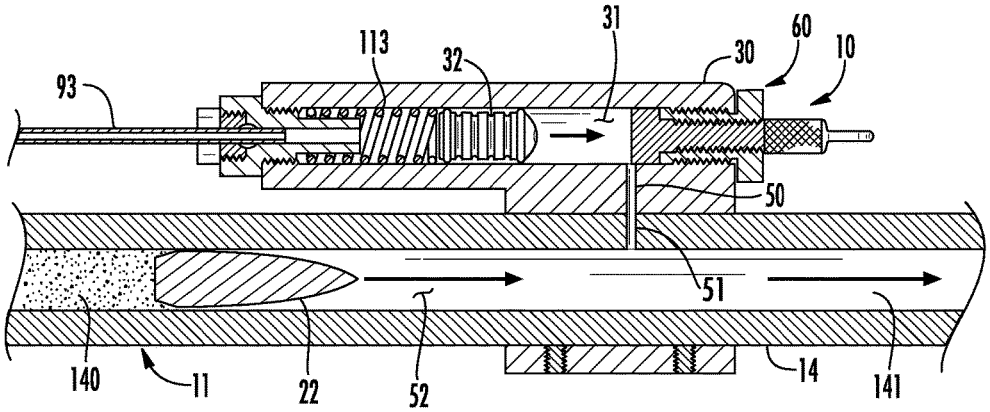

The operator uses the regulator 60 to adjust the amount of gas admitted into the cylinder 31. As the operator rotates the knob 72, the shaft 74 rotates in helical movement with respect to the outer nut 61, thereby slightly moving the rear face 81 of the block 73 forward and rearward. This moves the rear face 81 into and out of obstruction of the gas port 50. FIGS. 2-4 illustrate the rear face 81 approximately halfway over the gas port 50, such that the block 73 obstructs and occludes half of the gas port 50. Because the outer face 80 is snug against the inner surface 53 of the cylinder 31, the block 73 occludes an outlet 82 of the gas port 50; gas exiting the gas port 50 is forced to enter the cylinder 31 only through the restricted outlet 82. In this way, the operator tunes the regulator 60 to admit more or less gas from the barrel 14 into the cylinder 31.

Opposed from the regulator 60, at the rear 41 of the body 30, is a gas tube coupler 90. The coupler 90 includes a seal 91 and a compression fitting 92 carried in the seal 91. A gas tube 93—an outlet from the cylinder 31—extends out from the compression fitting 92 and rearward toward the chamber 15. The gas tube 93 has an inner diameter sufficient to communicate the slug of gas without pneumatic choke. The threads 55 at the rear 41 of the body 30 are directed radially inwardly to engage and hold the seal 91. The seal 91 is a cylindrical member having three tiered diameters. The seal 91 includes a main body 94 having outwardly-directed threads 95 which engage with the threads 55 on the body 30. A slender post 100 extends forwardly from the main body 94, and a mount 101 extends rearwardly from the main body 94. The diameter of the mount 101 is larger than the diameter of the main body 94, which is larger than the diameter of the post 100. Each of the main body 94, the post 100, and the mount 101 is cylindrical and coaxial to each other, and a coaxial bore 102 extends entirely through the seal 91.

The rear of the mount 102 has an annular, threaded socket 103 into which the compression fitting 92 is secured. The compression fitting 92 includes a compression nut 104 mounted over a compression ring 105, which in turn is fit over a forward end of the gas tube 93. The compression nut 104 has a head 110 and a hollow threaded shank 111, the interior of which is formed with an annular hold for receiving the compression ring 105. The socket 103 likewise has an annular hold for receiving the compression ring 105. However, the hold in the socket 103 and the hold in the compression nut 104, together, are just slightly smaller than the compression ring 105, so that when the compression nut 104 is threadably advanced into the socket 103 with the compression ring 105 disposed therebetween, the compression ring 105 is compressed or slightly crushed. When the gas tube 93 is inserted into the coupler 90 within the compression ring 105, and the compression nut 104 is so advanced, the compression ring 105 is crimped down onto the gas tube 95 to form a gas impermeable seal. In this way, the gas tube 93 is sealed to the coupler 90 and in turn also to the body 30.

The post 100 has a smaller diameter than the main body 94, the diameter of which is approximately equal to the inner diameter of the cylinder 31. Thus, the post 100 has a diameter smaller than that of the cylinder 31, and an annular gap 112 is defined between the post 100 and the inner surface 53 of the cylinder 31. This gap 112 is a receiving space for biasing means, such as a spring 113, mounted within the cylinder 31.

The piston 32 is mounted proximate to and forward of this spring 113 for reciprocal movement between the rear face 81 of the block 73, in a forward direction, and the post 100, in a rearward direction. The piston 32 is generally cylindrical, and has an outer diameter just less than the inner diameter of the cylinder 31. The piston 32 has a front 114, an opposed back 115, and an annular sidewall 116 extending therebetween. The piston 32 is a single, unitary structure formed from one piece of rugged, hard, and durable material, such as a metal like chromium steel alloy. The sidewall 116 is corrugated: a plurality of semi-circular annular channels 120 are formed inwardly into the sidewall 116. FIG. 2 illustrates the piston 32 having preferably four channels 120, though one having ordinary skill in the art will readily appreciate that greater or fewer channels may also be suitable. The channels 120 are axially spaced apart evenly between the front 114 and the back 115. The channels define nooks in which debris such as carbon—should any accumulate in the cylinder 31—can gather on the piston 32 without affecting the ability of the piston 32 to reciprocate efficiently. To that end, the piston 32 has two annular gaskets, or piston rings 121, carried proximate to the front 114 and the back 115. The piston rings 121, which are preferably lubricated, form a bearing surface for the piston 32 against the inner surface 53 of the cylinder 31. The piston rings 121 thus allow the piston 32 to ride smoothly within the cylinder 31 as the piston 32 reciprocates. Further, the piston rings 121 form a substantially impermeable gas seal between the piston 32 and the inner surface 53 of the cylinder 31, such that combustion gas cannot move rearward past the piston 32. The piston rings 121 are preferably metal, but in other embodiments are constructed from high-temperature rubber and plastic. The location of the piston rings 121 at the front 114 and back 115 provide the piston 32 with axial stability so that as the piston 32 reciprocates, it does not pitch or yaw, which could cause the piston 32 to bind within the cylinder 31.

The piston 32 reciprocates between a forward position and a rearward position in response to the application of combustion gas into the cylinder 31 from the gas port 50. In the forward position, almost shown in FIG. 2, the piston 32 is toward the block 73 of the regulator 60 and is in contact with the rear face 81 of the regulator 60. The front 114 of the piston 32 is convex, such that when the front 114 is against the rear face 81, there is still a small annular space around the front 114 of the piston 32 into which combustion gas can initially bleed from the gas port 50, thereby avoiding the formation of a total obstruction of the gas port 50. In other words, a "ring" volume is always maintained around the front 114 of the piston 32, even when the piston is fully forward.

In the rearward position of the piston 32, as shown in FIG. 3, the piston 32 fully compresses the spring 113. The spring 113 has a rear end 122 and an opposed front end 123. The spring 113 is a coiled, helical compression spring, and its rear end 122 encircles the post 100 and is seated in the gap 112 defined between the post 100 and the inner surface 53 of the cylinder 31. This arrangement prevents the complete compression of the spring which would crush it and destroy the power of the spring. The front end 123 of the spring 113 is flat against the flat back 115 of the piston 32, biasing the piston 32 forwardly into the forward position. However, when combustion gas acts on the piston 32 to push it rearwardly, the spring 113 is fully compressed. In this rearward position, the spring 113 compresses to a minimum compression length, as shown in FIG. 3, and the back 115 of the piston 32 is spaced just in front of the post 100. Thus, the spring 113 acts as a limiter or stop for rearward movement of the piston 32. In other embodiments for other firearms, the spring 113 is capable of further compression, and the front end of the post 100 is a limiter or stop for rearward movement of the piston 32.

Figure 5:
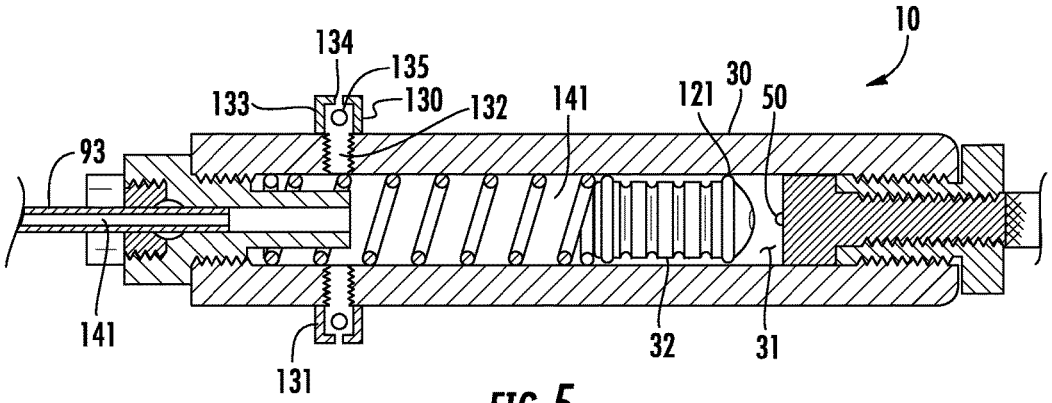
FIGS. 5 and 6 are enlarged section views of the operating system and the firearm taken along the line 5-5 in FIG. 1, showing a sequence of operational stages of the operating system.
Figure 6:
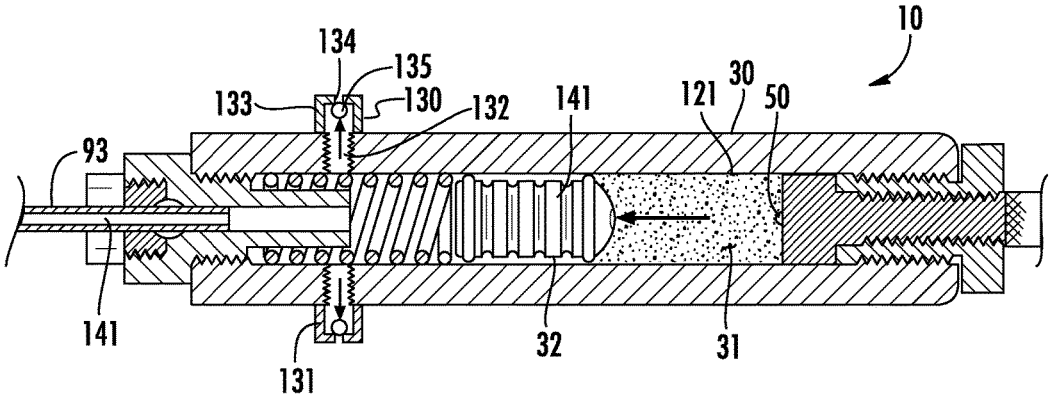

After the combustion gas moves the piston 32 to the rearward position of FIG. 3, the spring 113 biases the piston 32 back toward the forward position, as shown in FIG. 4 (the piston 32 is moving to the forward position along the arrowed line). Turning now to FIGS. 5 and 6, which are section views of the operating system 10 taken along the line 5-5 in FIG. 1, left and right check valves 130 and 131 can be seen on the body 30. The check valves 130 and 131 are identical in every manner except location on the body 30, and thus only the check valve 130 will be described, with the understanding that the description applies equally to the check valve 131. Indeed, the same reference characters are used for the constituent structural elements and features of the check valve 130 and the check valve 131. The check valves 130 and 131 are located on opposed sides of the body 30, opposite each other. The check valves 130 and 131 are located axially along the body 30 behind a rearward stop for the piston 32: behind the minimum compression distance of the spring 113, and just behind the front of the post 100.

The check valve 130 is threadably applied to the body 30, and includes a bore 132 extending through the body 30 to a valve body 133, to which the bore 132 is coupled in gaseous communication. The bore 132, in turn, is coupled in gaseous communication to the cylinder 31. Thus, the check valve 130 is coupled in gaseous communication directly to the cylinder 31, and to the gas in the cylinder 31 behind the piston 32. Further, because the check valve 130 is at all times behind the piston 32, the check valve 130 is not coupled in gaseous communication with the volume of gas in the cylinder 31 in front of the piston 32; the check valve 130 is prevented from gaseous communication with the volume of gas in the cylinder 31 in front of the piston 32. In other words, the check valve 130 is not coupled in gaseous communication with any combustion gas. A port 134, opposite the bore 132, is formed through the valve body 133. The valve body 133 carries a ball 135, which has a diameter greater than that of the bore 132 and the port 134, but less than the inner dimension of the valve body 133. Therefore, the ball 135 can move within the valve body 133, and does move in response to movement of the piston 32 after application of combustion gas into the cylinder 31.

The operating system 10 is an extremely lightweight, efficient, and reliable method of cycling the action of the firearm 11. Below, a very brief discussion describes the operation, with a more detailed description following. When the operator fires the firearm 11, the bullet 22 travels down the interior 52 of the barrel 14, propelled by expanding combustion gas. That combustion gas bleeds into the gas port 50 and then into the cylinder 31, where it pushes the piston 32 rearward. Because the piston 32 is sealed against the inner surface 53 of the cylinder, a slug of air behind the piston 32 is confined and isolated from the combustion gas. That slug of air is moved rearward into the gas tube 93 and then back into the gas key 34, where the gas key 34 routes the slug of air to force the cycling of the action. Once the bullet 22 has exited the muzzle 16, the combustion gas exhausts out the muzzle 16 as well, and the piston 32 returns to its forward position, urged forward by the spring 113. Air is drawn into the cylinder 31 through the check valves 130 and 131, thereby re-supplying the slug of air behind the piston 32. The firearm 11 is thus readied for firing again.

Turning now to FIG. 2, the firearm 11 has just been fired. The bullet 22 is moving forwardly through the interior 52 of the barrel 14. Combustion gas 140 is expanding behind the bullet 22; ambient air 141 is in front of the bullet 22 (the combustion gas 140 is shown throughout the drawings as a "sand infill" or stippling; the ambient air 141 is shown as whitespace). The ambient air 141 is simply the air in the environment, typically atmosphere that the operator is breathing. The ambient air 141 also already fills the gas port 50 and the cylinder 31. The ambient air 141 fills the cylinder 31 both in front of and to the rear of the piston 32. Lastly, the ambient air fills the gas tube 93 back to the gas key 34 and the bolt carrier 25.

Before the bullet 22 passes the gas port 51, the piston 32 is in the forward position, or returning thereto. FIG. 2 shows the piston 32 returning to the forward position, just behind it. Likewise, FIG. 5 shows the piston 32 similarly, returning to the forward position. In FIG. 5, it can be seen that the check valves 130 and 131 are open, such that ambient air 141 enters the cylinder 31 through the check valves 130 and 131.

Once the bullet 22 passes the gas port 51, as shown in FIG. 3, the combustion gas 140 enters the gas ports 50 and 51 and enters the cylinder 31. This exerts a force on the piston 32 in the direction indicated by the arrowed line A in FIG. 3, moving the piston 32 rearwardly in opposition to the spring 113, which exerts a forward bias on the piston 32. The force along line A, however, is greater than the forward bias of the spring 113, and so the piston 32 moves rearward. In an embodiment, the piston 32 is sealed against the inner surface 53 of the cylinder with a accurately-machined slip fit. In the embodiment shown in the drawings, the piston 32 is sealed against the inner surface 53 of the cylinder 31 with the piston rings 121, and so the combustion gas 140 cannot move around the piston 32; it can only move the piston 32 rearward. The piston 32, therefore, isolates the combustion gas 140 from ambient air 141 and operates as a displacement means on the ambient air 141. As the piston 32 moves rearward, the ambient air 141 to the rear of the piston 32 cannot move around the piston 32 because of the seals formed by the piston rings 121, and thus the ambient air 141 can only move in three ways: out the check valve 130, out the check valve 131, or out the gas tube 93. However, because the piston 32 moves back rapidly in response to expansion of combustion gas 140 into the cylinder 31, the balls 135 in the check valves 130 and 131 are forced outwardly against the valve bodies 133, seating into and occluding the ports 134, as shown in FIG. 6. Thus, the check valves 130 and 131 are both closed, and the ambient air 141 to the rear of the piston 32 is forced to move rearwardly into the gas tube 93. The ambient air 141 in the decreasing volume of space to the rear of the rearwardly-moving piston 32 is constricted into the gas tube 93 into a slug of gas or air 141. A slug is defined herein as a single, momentary, sudden, discrete, and defined applied volume of pressurized air moving as a unit or as a single volume or burst, disparate from surrounding de-pressurized gas or air. It is contrasted with a slow leak, a slow application, or an application of air lacking a sharply defined beginning and ending. This slug of air 141, because it is travelling rapidly by virtue of the speed with which the piston 32 moves reawardly and the constriction into the gas tube 93 (which constriction is not so severe as to pneumatically choke the movement of the slug), moves quickly rearwardly through the gas tube 93 and into the gas key 34 and the bolt carrier 25. The slug of ambient air 141 is thus applied to the bolt carrier 25 immediately in response to the expansion of combustion gas 140 into the cylinder 31. Because the piston 32 forms two seals with the inner surface 53 of the cylinder 31, no combustion gas 140 can be passed to the bolt carrier 25, and the bolt carrier 25 is not dirtied. Further, the application to the bolt carrier 25 of ambient air 141, rather than hot combustion gas 140, prevents the action of the firearm 11 from heating up as quickly.

Combustion gas 140 fills the interior 52 of the barrel 14 until the bullet 22 exits the barrel 14 through the muzzle 16. Consequently, much of the combustion gas 140 exits the barrel 14 through the muzzle 16 as well. Combustion gas 140 empties from the interior 52, the gas ports 50 and 51, and the cylinder 31. With the combustion gas 140 emptying from the cylinder 31, the pressure from the combustion gas is likewise decreased, and there is no longer a rearward force against the piston 32 along the line A. As such, the returning force of the spring 113 urges the piston 32 forwardly, as shown in FIG. 4. Because the piston 32 is sealed to the cylinder 31, the piston 32 creates a vacuum to its rear, causing the balls 135 in the check valves 130 and 131 to unseat from the ports 134, as shown in FIG. 5. When the balls 135 unseat, and as the piston 32 moves forward, ambient air 141 is drawn into the cylinder 31 behind the piston 32, in addition to a volume of ambient air drawn from the gas tube 93. This prevents the formation of a vacuum behind the piston 32, or acts as a vacuum breaker, so as to allow the piston to move. Thus, the piston 32 is again surrounded by ambient air 141 as it returns to the forward position, ready to move in response to the firearm 11 again being fired. FIG. 4, indeed, shows that the firearm 10 has been fired, though the bullet 22 has not yet traveled far enough down the barrel 14 to affect the operating system 10.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. An operating system for a firearm, the operating system comprising:

a body, configured to be mounted to a firearm, having an interior space, a front, and an opposed rear; a gas tube extending from the body and configured to be coupled to a bolt carrier of the firearm; a piston carried within the interior space for reciprocation between a forward position toward the front and a rearward position toward the rear;

a gas port formed proximate to the front of the body, and an outlet formed proximate to the rear of the body;

first and second gases forwardly and rearwardly flanking the piston, respectively, wherein the first and second gases are isolated from each other;

the piston moves to the rearward position in response to expansion of the first gas, thereby imparting movement of the second gas through the outlet; and the piston moves to the forward position in response to contraction of the first gas.

2. The operating system of claim 1, further comprising biasing means urging the piston into the forward position.

3. The operating system of claim 2, wherein the biasing means comprises a spring disposed between the piston and the rear of the body.

4. The operating system of claim 1, wherein axially-spaced apart annular grooves are formed into the piston.

5. The operating system of claim 1, further comprising:

a gasket encircling the piston;

the gasket defines a bearing surface against the body; and a gas impermeable seal is formed among the piston, the gasket, and the body.

6. The operating system of claim 1, wherein the piston has a convex front.

7. The operating system of claim 1, further comprising a check valve carried in the body to the rear of the piston such that, when the piston is in the rearward position, the check valve is behind the piston.

8. An operating system for cycling a bolt carrier of a firearm, the operating system comprising:

a housing containing a first gas and a second gas different from the first gas; a gas tube extending from the housing and configured to be coupled to a bolt carrier of a firearm; displacement means disposed between and isolating the first gas from the second gas; and the displacement means is mounted for reciprocal movement in the housing, the displacement means imparts movement to the second gas in response to movement of the first gas against the displacement means.

9. The operating system of claim 8, wherein the gas tube is coupled in gaseous communication with the housing to receive the second gas and not the first gas.

10. The apparatus of claim 8, further comprising a seal formed between the housing and the displacement means preventing the first gas from reaching the second gas.

11. The operating system of claim 8, wherein the displacement means is a piston.

12. The operating system of claim 11, further comprising a spring biasing the piston into the first gas.

13. The operating system of claim 11, further comprising a check valve coupled in gaseous communication with the second gas in the housing.

14. The operating system of claim 13, wherein the check valve is not coupled in gaseous communication with the first gas.

15. An operating system for cycling a bolt carrier of a firearm, the operating system comprising:

a body, configured to be mounted to a firearm, having an interior space, a front, and an opposed rear;

a piston carried within the interior space for reciprocation between a forward position toward the front and a rearward position toward the rear;

a gas tube configured to be coupled to a bolt carrier of a firearm; and a slug of air in the interior space behind the piston;

wherein expansion of a gas into the interior space in front of the piston moves the piston to the rearward position, thereby imparting movement of the slug of air into the gas tube.

16. The operating system of claim 15, further comprising biasing means urging the piston into the forward position.

17. The operating system of claim 16, wherein the biasing means comprises a spring disposed between the piston and the rear of the body.

18. The operating system of claim 15, wherein axially-spaced apart annular grooves are formed into the piston.

19. The operating system of claim 15, further comprising:

a gasket encircling the piston;

the gasket defines a bearing surface against the body; and a gas impermeable seal is formed among the piston, the gasket, and the body.

20. The operating system of claim 15, further comprising a check valve carried in the body behind a stop for the piston, such that, when the piston is in the rearward position, the check valve is behind the piston.

* * * * *